US006750744B2

(12) United States Patent
Misumi et al.

(10) Patent No.: US 6,750,744 B2
(45) Date of Patent: Jun. 15, 2004

(54) ELECTROMAGNETIC RELAY

(75) Inventors: Syuichi Misumi, Kyoto (JP); Yuichi Kariya, Kyoto (JP); Hiroyuki Miyano, Kyoto (JP); Shigekazu Aoki, Kyoto (JP); Kenji Nakamura, Kyoto (JP); Tatsuro Ishikawa, Kyoto (JP); Takehiko Nakagawa, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/228,270

(22) Filed: Aug. 27, 2002

(65) Prior Publication Data

US 2003/0052759 A1 Mar. 20, 2003

(30) Foreign Application Priority Data

Aug. 31, 2001 (JP) ..... 2001-263957
Dec. 12, 2001 (JP) ..... 2001-378551

(51) Int. Cl.[7] ..... H01H 51/22
(52) U.S. Cl. ..... 335/78; 335/80; 335/85
(58) Field of Search ..... 335/78–86

(56) References Cited

U.S. PATENT DOCUMENTS 5,317,294 A * 5/1994 Vielot ..... 335/80
5,801,608 A * 9/1998 Mader ..... 335/128
5,852,392 A * 12/1998 Aharonian ..... 335/80
5,905,422 A * 5/1999 Doneghue ..... 335/78
6,023,212 A * 2/2000 Mader ..... 335/202
6,232,858 B1 * 5/2001 Reiter ..... 335/80

* cited by examiner

*Primary Examiner*—Ramon M. Barrera
(74) *Attorney, Agent, or Firm*—Morrison & Foerster LLP

(57) ABSTRACT

An electromagnetic relay is provided with an iron core (50) which has a virtually J-letter shape on a plan view with one end serving as a support-receiving portion (51) and the other end serving as a magnetic pole portion (52), and a movable iron member (60) which is supported by a movable contact member (70) attached to a corner thereof, and has a virtually L-letter shape on a plan view with one end (61) being supported on the support-receiving portion (51) of the iron core (50) so as to freely pivot thereon and an adsorb portion (62) that is the other end being allowed to face the magnetic pole portion (52) of the iron core (50) so as to be adsorbed thereon. The objective of the present invention is to provide an inexpensive electromagnetic relay which is less susceptible to deviations in the adsorb portion of the movable iron member that comes into contact with and separates from the magnetic pole portion of the iron core, and has stable operation characteristics.

4 Claims, 15 Drawing Sheets

ELECTROMAGNETIC RELAY

TECHNICAL FIELD

The present invention relates to an electromagnetic relay, and more particularly concerns an assembling structure in which an iron core and a movable iron member are installed.

RELATED BACKGROUND ART

Conventionally, with respect to electromagnetic relays, for example, Japanese Laid-Open Patent Application No. 2000-222990 has disclosed one of those relays.

In this relay, a gate-shaped fixed iron core around which an exciting coil has been wound is placed in a housing, and a switching mechanism, constituted by a movable contact member and a fixed contact member, is placed in a recessed section of this gate-shaped fixed iron core, and an armature is placed in a manner so as to virtually close the recessed section, and in this arrangement, this armature is made in contact with one of the two leg members of the gate-shaped fixed iron core, while it is made in contact with and separated from the other end of the two leg members, so as to carry out swinging processes; thus, a protrusion formed in the middle of the armature is allowed to push the above-mentioned contact member so as to turn on and off the above-mentioned switching mechanism.

However, the above-mentioned electromagnetic relay has virtually the same shape on the two ends of its armature, and also has virtually the same weight. For this reason, when the swinging process is carried out with one end of the above-mentioned armature being in contact with one of the two leg members of the gate-shaped fixed iron core and the other end being made in contact with and separated from the other of the two leg members thereof, the other end of the armature, which is made in contact with and separated from the iron core, tends to deviate. Consequently, the above-mentioned electromagnetic relay tends to fail to provide stable operation characteristics.

Moreover, the above-mentioned gate-shaped fixed iron core is not assembled onto a spool that has been molded, and consequently, it is necessary to carry out an insert-molding process. Therefore, an expensive insert-molding device, which needs time-consuming and difficult operations in transporting parts, is required, resulting in high production costs.

SUMMARY OF THE INVENTION

The present invention has been devised to solve the above-mentioned problems, and its objective is to provide an inexpensive electromagnetic relay in which the adsorb portion of the movable iron member, which is made in contact with and separated from the magnetic pole portion of the iron core, is less susceptible to deviations, and which has stable operation characteristics.

In order to achieve the above-mentioned objective, an electromagnetic relay of the present invention is provided with: an iron core which has a virtually L-letter shape on a plan view with one end serving as a support-receiving portion and the other end serving as a magnetic pole portion, and is provided with an exciting coil wound around in the middle portion thereof; a movable iron member which is supported by a hinge spring adsorb to a corner thereof, and has a virtually L-letter shape on a plan view with one end being supported on the support-receiving portion so as to freely pivot thereon and the other end being allowed to face the magnetic pole portion of the iron core so as to be adsorbed thereon; and a contact unit which allows a fixed contact and a movable contact to contact each other and to separate from each other through rotation of the movable iron member.

In accordance with the present invention, one end of the movable iron member, which is supported by the support-receiving portion of the iron core so as to freely pivot thereon, is designed to have a wider width and to be heavier than that of the other end of the movable iron member that faces the magnetic pole portion of the iron core so as to be adsorbed thereto. Therefore, even when the movable iron member is allowed to pivot through the hinge spring, the other end of the movable iron member is less susceptible to deviation; thus, it becomes possible to provide an electromagnetic relay having stable operation characteristics.

Moreover, since the iron core can be assembled onto a molded spool, it is possible to eliminate the necessity of the insert-molding process, and consequently to provide an inexpensive electromagnetic relay having low production costs.

Another electromagnetic relay of the present invention is provided with: an iron core which has a virtually J-letter shape on a plan view with one end serving as a support-receiving portion and the other end serving as a magnetic pole portion, and is provided with an exciting coil wound around in the middle portion thereof; a movable iron member which is supported by a hinge spring adsorbed to a corner thereof, and has a virtually L-letter shape on a plan view with one end being supported on the support-receiving portion so as to freely pivot thereon and the other end being allowed to face the magnetic pole portion of the iron core so as to be adsorbed thereon; and a contact unit which allows a fixed contact and a movable contact to contact each other and to separate from each other.

In accordance with this invention, in addition to the above-mentioned effects, the length from the corner of the movable iron member to the pivotal tip portion is set to be shorter than an electromagnet block. Consequently, the moment of inertia around the pivotal axis of the above-mentioned movable iron member becomes smaller, thereby making the operation speed of the movable iron member faster; therefore, it is possible to provide an electromagnetic relay having swift operation characteristics.

Moreover, in another embodiment of the present invention, one end of the iron core may be inserted into and attached to a through hole of a spool around which the exciting coil has been wound.

In accordance with the present embodiment, it is possible to eliminate the necessity of an expensive insert-molding device which needs time-consuming and difficult operations in transporting parts, and consequently to provide an inexpensive electromagnetic relay having low production costs.

In still another embodiment of the present invention, the hinge spring may be prepared as a movable contact member.

In accordance with the present embodiment, since a movable contact member is attached to the movable iron member having stable operation characteristics, it is possible to provide an electromagnetic relay having stable switching characteristics and superior response characteristics.

In the another embodiment of the present invention, an insertion-receiving section to which a position regulating protrusion, formed on the bottom face of a base, is fitted so as to freely move therein, is formed in the vicinity of a corner of the movable iron member. Here, the above-mentioned insertion-receiving section in accordance with this aspect may be a recessed section that is formed by an extrusion machining process, or a through hole that is formed by press working.

In accordance with the present embodiment, an insertion-receiving section of the movable iron member is fitted to a position regulating protrusion formed on the bottom face of a base, so as to freely move thereon. For this reason, even when an impact force is externally applied thereto, the movable iron member is position-regulated by the above-mentioned protrusion so that it is possible to prevent the hinge spring attached to the movable iron member from being plastically deformed, and consequently to prevent the movable iron member from coming off.

BRIEF DESCRIPTION OF THE DRAWINGS

FIG. 3 is a perspective view showing a manufacturing method of a base shown in FIG. 2.

FIG. 8 shows a state in which the electromagnetic relay of FIG. 1 has been assembled.

FIG. 9 shows a base shown in FIG. 1.

FIG. 10 shows a state in which the movable iron member and the movable contact member have been removed from the base shown in FIG. 9.

FIG. 11 shows a second embodiment of an electromagnetic relay of the present invention.

DESCRIPTION OF THE SPECIAL EMBODIMENTS

Figure 1:
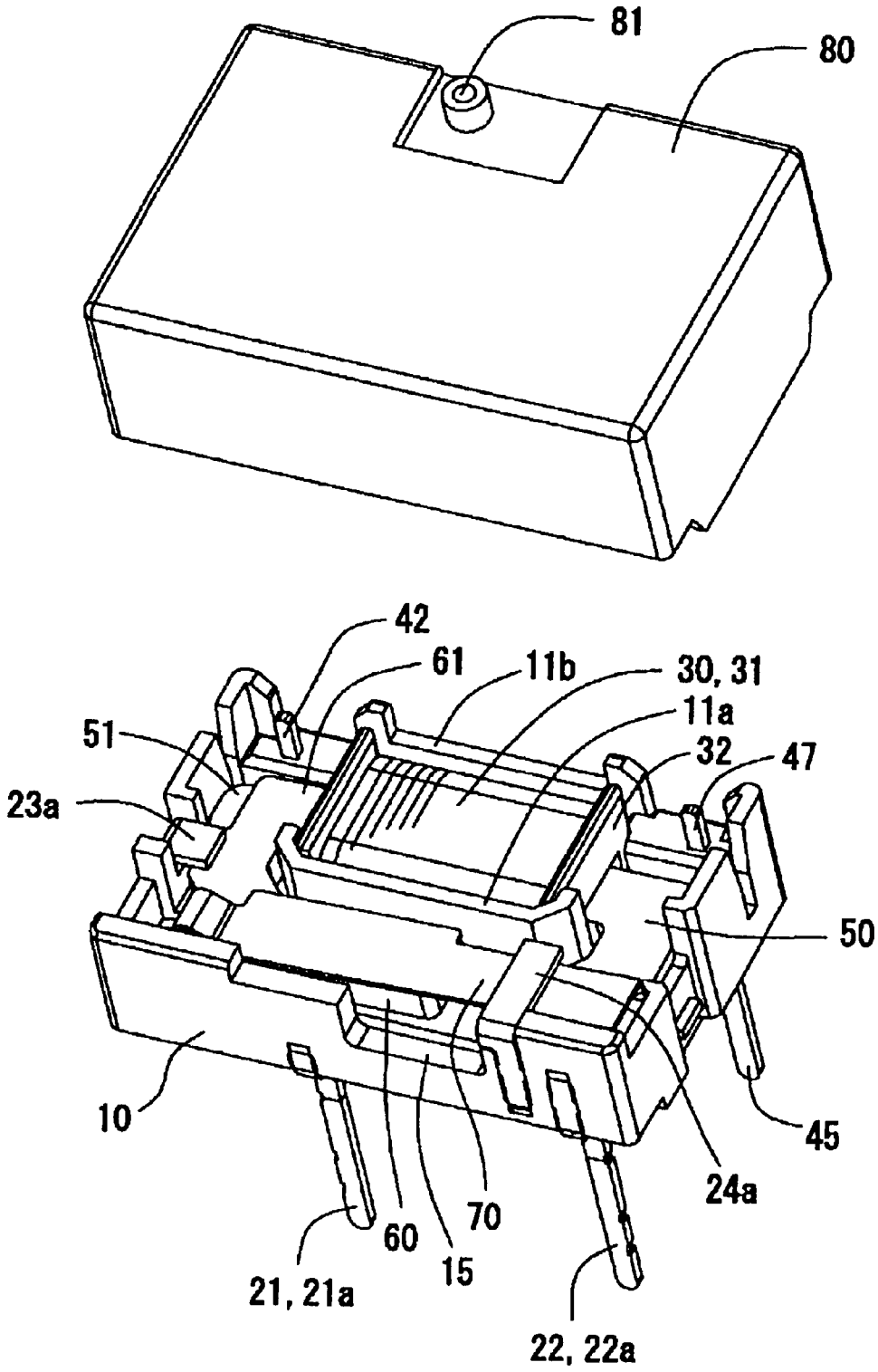
FIG. 1 is an exploded perspective view showing an electromagnetic relay in accordance with a first embodiment of the present invention.

Referring to attached FIGS. 1 through 15, the following description will discuss embodiments of the present invention.

As shown in FIGS. 1 through 10, the first embodiment of the present invention is an electromagnetic relay that is schematically provided with a base 10, an electromagnet block 30, a movable iron member 60, a movable contact member 70 and a case 80.

Figure 2:
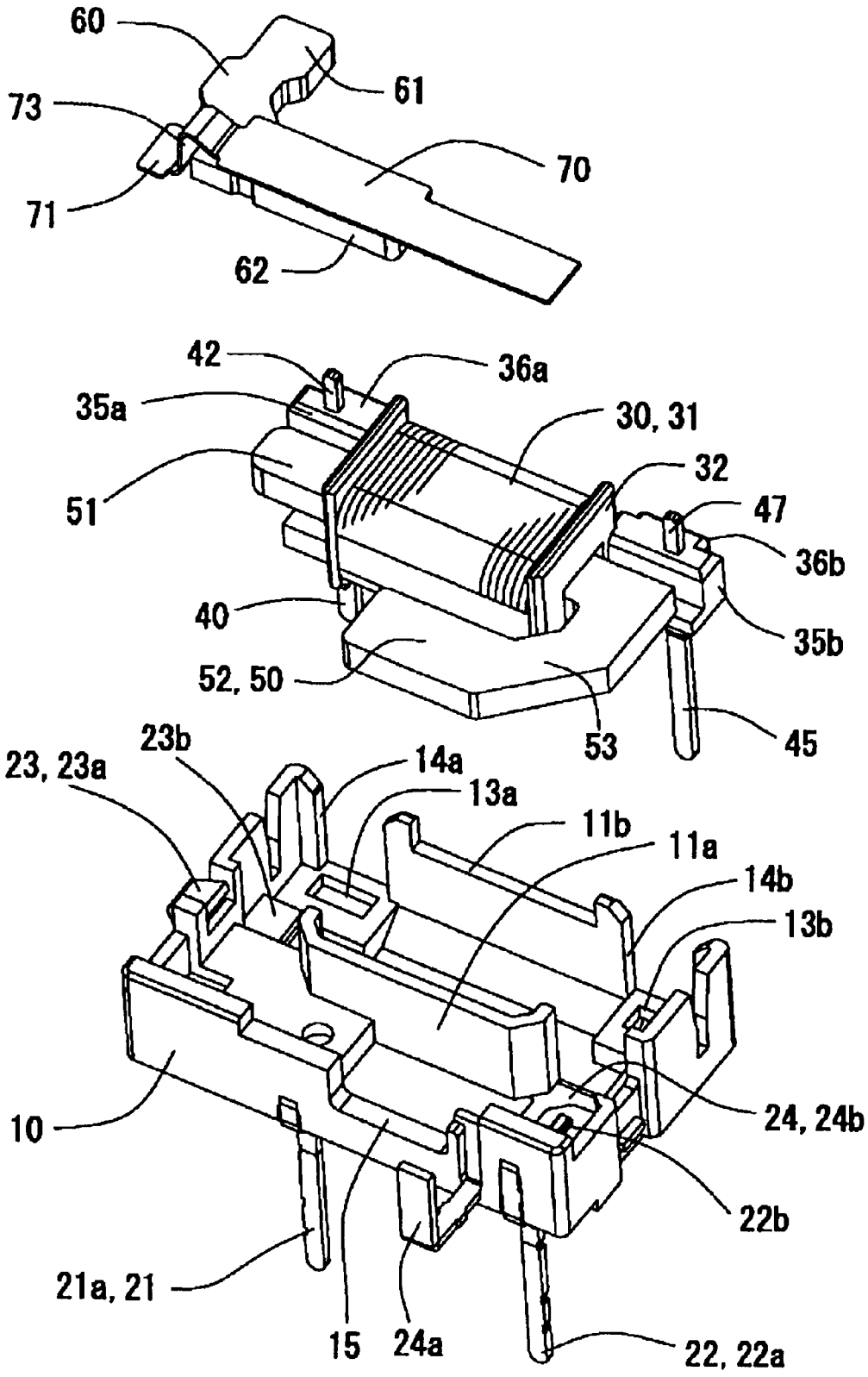
FIG. 2 is an exploded perspective view showing a state in which an electromagnet block and a movable iron member have been removed from the base shown in FIG. 1.
Figure 3A:
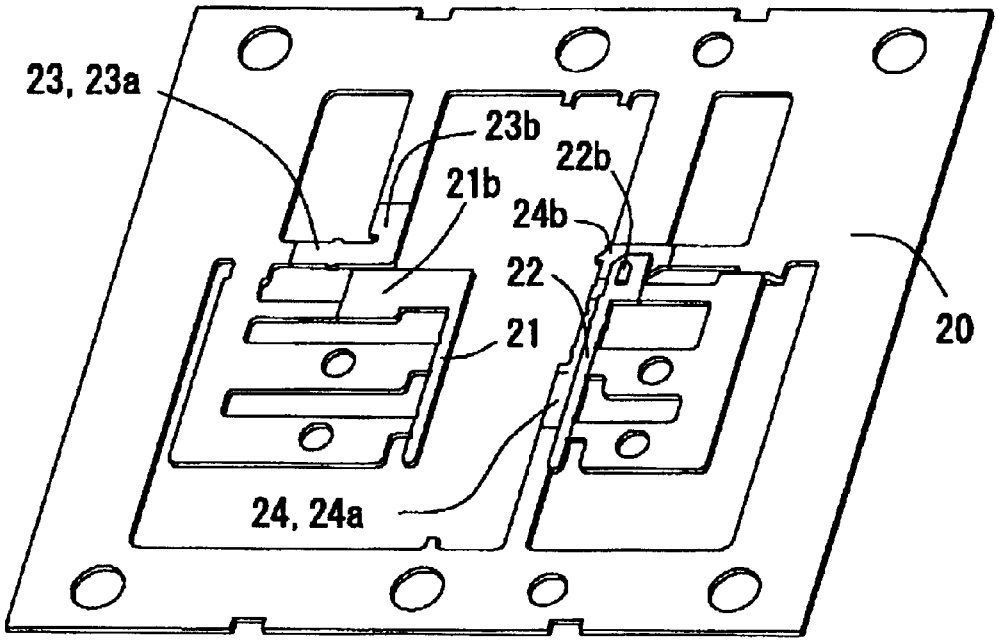
FIG. 3A is a perspective view showing a lead frame.
Figure 3B:
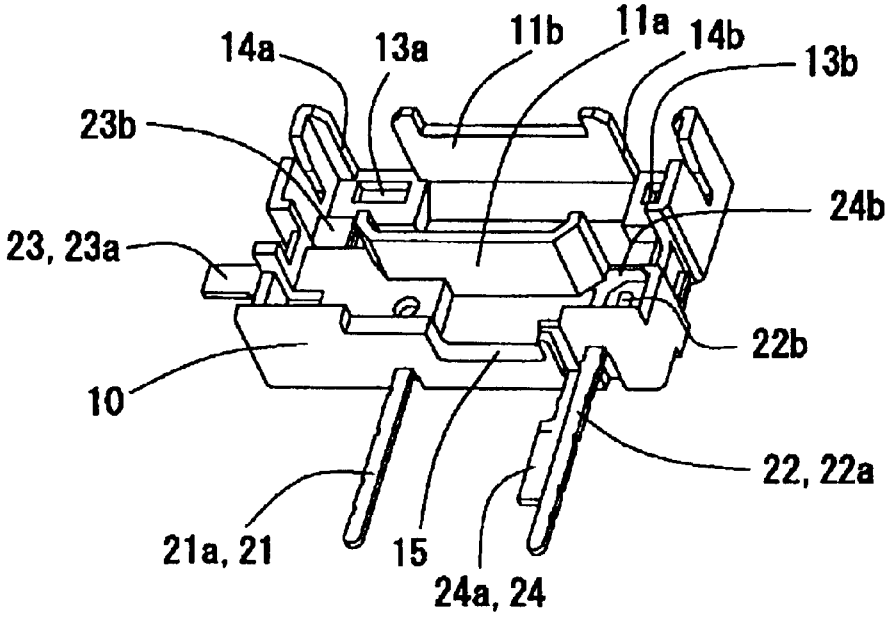
FIG. 3B is a perspective view showing a state immediately after the formation of the base.

This base 10 is formed by insert-molding a lead frame 20 shown in FIG. 3A, cutting the frame off (FIG. 3B), and then subjecting this to a bending process (FIG. 2). The lead frame 20 is provided with a movable contact terminal 21, a fixed contact terminal 22, a movable-iron-member position-regulating member 23 and a movable-contact-member position regulating member 24, which are punched out, and bent and raised.

Figure 7:
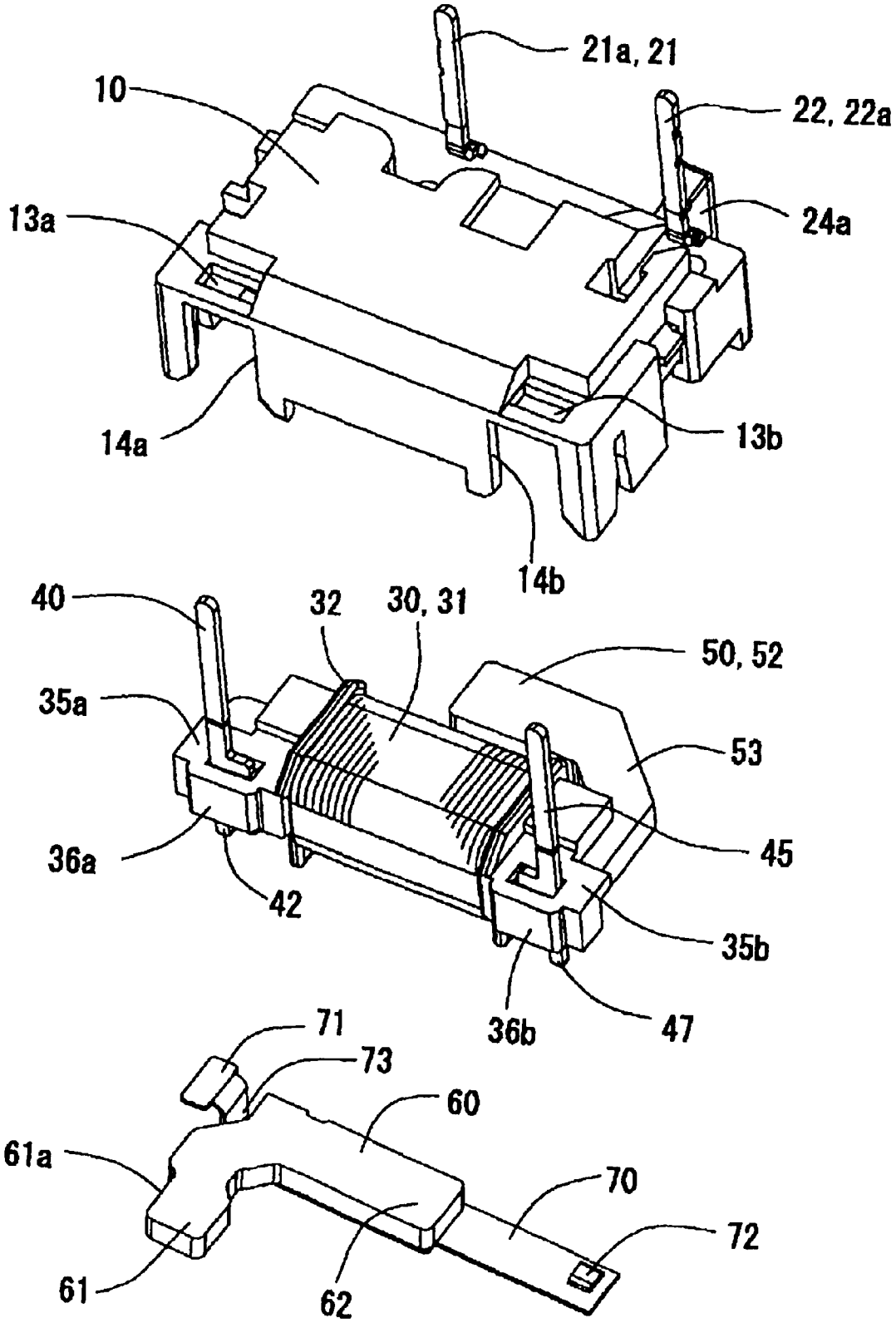
FIG. 7 is an exploded perspective view showing a state in which an electromagnet block and a movable iron member have been removed from the base shown in FIG. 6.
Figure 8A:
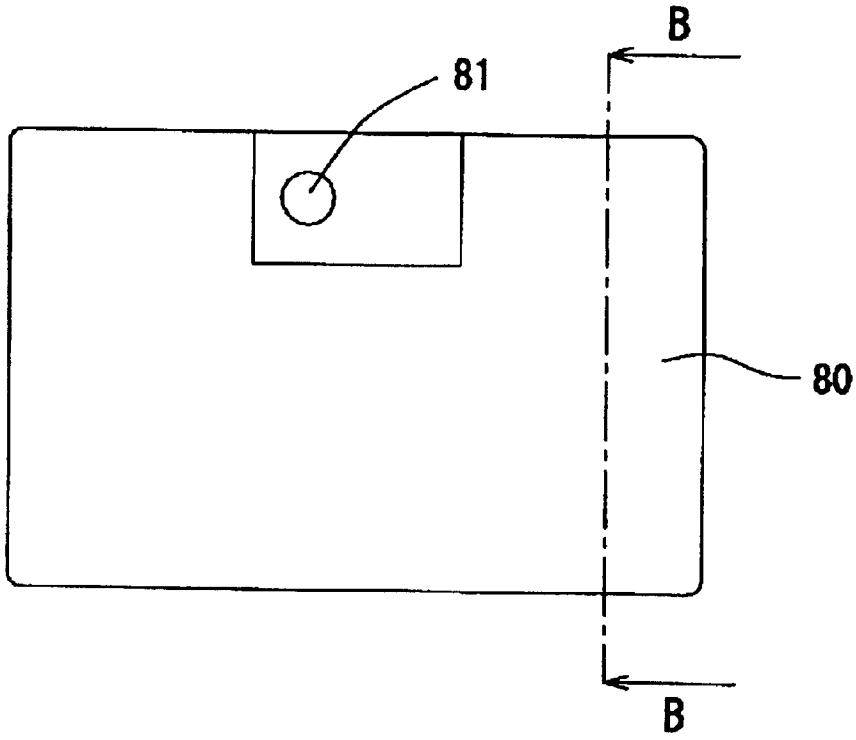
FIG. 8A is a plan view.
Figure 8B:
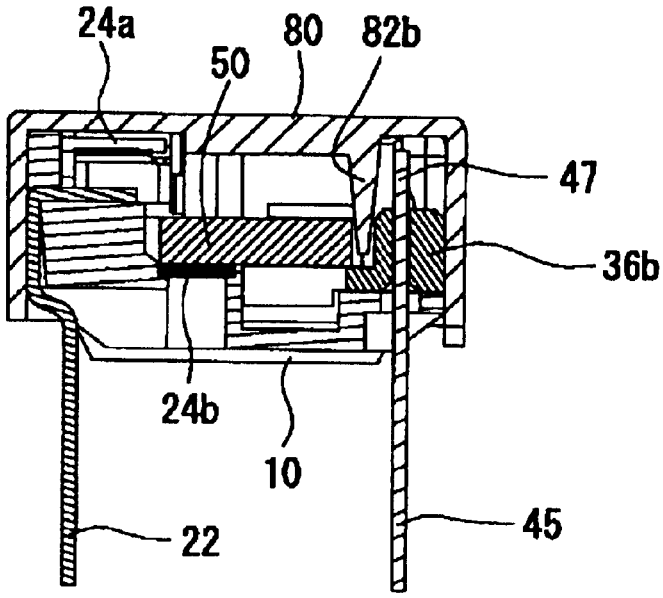
FIG. 8B is a cross-sectional view taken along line B—B of FIG. 8A.

In particular, the terminal portions 21*a*, 22*a* of the movable contact terminal 21 and the fixed contact terminal 22 are bent inward of the base 10 so as to be positioned on the same straight line (FIG. 7). Moreover, a fixed contact 22*b* of the fixed contact terminal 22 is exposed to the bottom face of the base.

Moreover, position-regulating tongue-shaped members 23*a*, 24*a*, which are positioned on respective ends of the movable-iron-member position-regulating member 23 and the movable-contact-member position-regulating member 24, are respectively bent to have virtually right angles. Here, the above-mentioned position-regulating tongue-shaped members 23*a*, 24*a* are shown as states in the middle of manufacturing processes.

On the other hand, position-determining portions 23*b*, 24*b*, which are the other ends of the movable-iron-member position-regulating member 23 and the movable-contact-member position-regulating member 24, are exposed to the bottom face of the base 10 so as to form reference faces.

As shown in FIG. 2, an insulating wall 11*a* and a partition wall 11*b* are placed side by side on the bottom face of the above-mentioned base 10, and coil terminal holes 13*a*, 13*b* are formed in the vicinity of both sides of the partition wall 11*b*. Moreover, a pair of cut-out sections 14*a*, 14*b*, to which an electromagnet block 30, which will be described later, is fitted, are formed in one of the opposing side walls of the base 10, and an adjusting-use cut-out section 15 is formed on the other side wall.

Figure 4A:
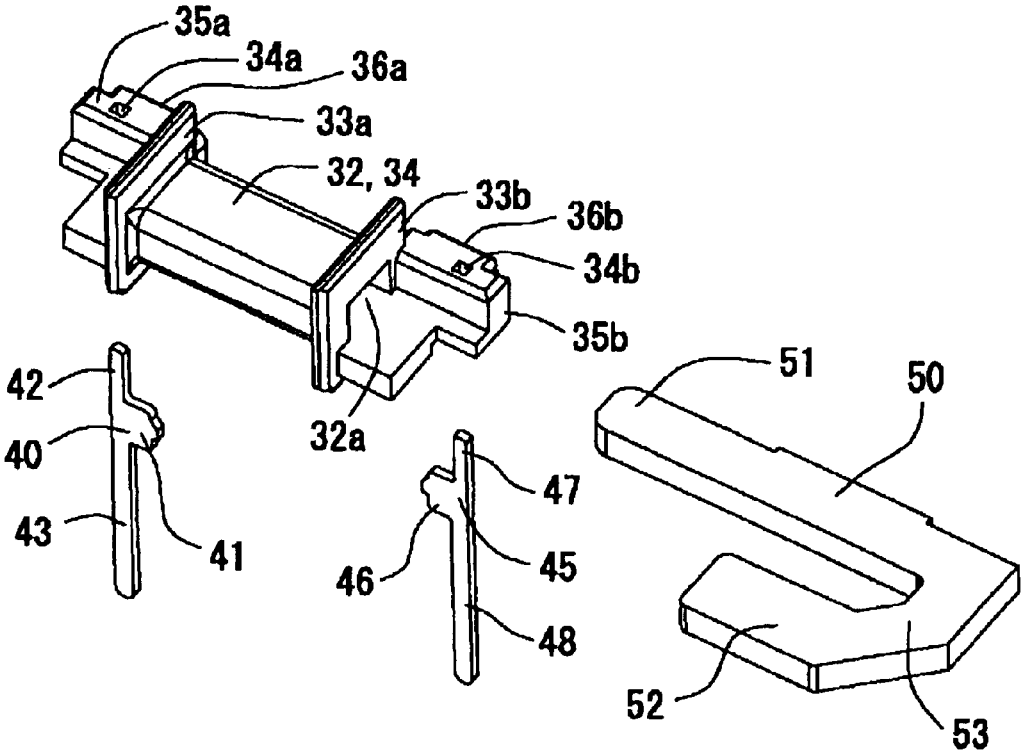
FIG. 4A is a perspective view showing the electromagnet block shown in FIG. 2.
Figure 4B:
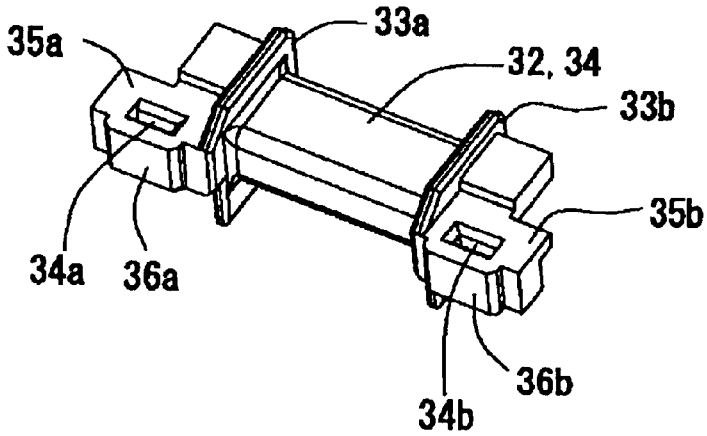
FIG. 4B is a perspective view showing a spool viewed from a different angle.

As shown in FIGS. 4A, 4B, the electromagnetic block 30 is constituted by a spool 32 on which a coil 31 is wound, a pair of coil terminals 40, 45 and an iron core 50.

The spool 32 is provided with a trunk portion 34 that has flange portions 33*a*, 33*b* on its two ends, with a through hole 32*a* to which the iron core 50 is inserted being formed therein. Further, mount portions 35*a*, 35*b* having coil-terminal holes 34*a*, 34*b* are attached to the above-mentioned flange portions 33*a*, 33*b* in a manner so as to extend therefrom. Protrusions 36*a*, 36*b*, which are respectively fitted to the cut-out sections 14*a*, 14*b* of the above-mentioned base 10, are formed on the outside faces of the mount portions 35*a*, 35*b*.

Coil terminals 40, 45 are respectively provided with positioning-use wide-width portions 41, 46 formed thereon. Then, the coil terminals 40, 45 are respectively press-inserted into the coil terminal holes 34*a*, 34*b* of the spool 32 from below so that coil connecting portions 42, 47 thereof are allowed to respectively protrude from the above-mentioned mount portions 35*a*, 35*b*.

As shown in FIG. 4A, the iron core 50 is formed by a plate-shaped magnetic material having a virtually J-letter shape on its plan view. Here, the above-mentioned iron core 50 has its one end formed into a support-receiving portion 51 of a movable iron member 60, which will be described later, with the other end being formed into a magnetic pole portion 52.

Therefore, the two ends of the coil 31 wound around the trunk portion 34 of the spool 32 are connected to the coil connecting portions 42, 47 of the coil terminals 40, 45 to be soldered thereto, and one end 51 of the iron core 50 is then inserted into the through hole 32*a* of the above-mentioned spool 32 so that the electromagnetic block 30 is completed.

In the present embodiment, since the iron core 50 and the coil terminals 40, 45 need not to be insert-molded into the electromagnetic block 30, it is possible to cut expensive equipment investments.

Further, the above-mentioned electromagnetic block 30 is inserted between the insulating wall 11*a* and the partition wall 11*b* that are placed in parallel with each other on the above-mentioned base 10. Next, the terminal portions 43, 48 of the coil terminals 40, 45 are inserted into the coil terminal holes 13*a*, 13*b* of the base 10. Thus, the protrusions 36*a*, 36*b* of the electromagnet block 30 are fitted to the cut-out sections 14*a*, 14*b* of the base 10 to be exposed thereto. Therefore, in accordance with the present embodiments, the coil terminals 40, 45 can be placed outside the side wall of the base 10 with a gap corresponding to its thickness, while maintaining a predetermined pitch. Consequently, it is possible to provide an electromagnetic relay that occupies only a small floor area.

Moreover, the support-receiving portion 51 of the iron core 50 is placed at the position-determining portion 23*b* of the position-regulating member 23 (FIG. 10C), and the bending portion 53 of the iron core 50 is placed at the position-determining portion 24*b* of the position-regulating member 24 (FIG. 8B); thus, these portions are then welded through resistance welding or laser welding to be integrally formed thereon.

In accordance with the present embodiment, the electromagnetic block 30 can be positioned on the base 10 with high assembling precision. Moreover, since it is integrally welded through resistance welding, etc., the electromagnet block 30 is not dislocated within the base 10 even upon application of a thermal stress or an impact force, etc.; thus, the resulting advantage is that there is no change in the operation characteristics.

In the above-mentioned embodiment, the laser welding is applied to the bottom face of the base 10 from above the base 10; however, the welding process may be carried out by applying the laser beam to the bottom face from below the base 10.

In other words, laser welding holes may be formed in the bottom face of the base 10, and a laser beam may be directly applied to the position-determining portions 23*b*, 24*b* that can be viewed through these laser welding holes so that the iron core 60 may be welded into an integral portion.

Alternatively, through holes may also be formed in the above-mentioned position-determining portions 23*b*, 24*b* so as to be viewed through the above-mentioned laser welding holes. Then, the iron core 60, which is superposed on the through holes of the position-determining portions 23*b*, 24*b*, maybe subjected to laser application so as to be welded into an integral portion.

Here, it is only necessary to provide at least one portion that is to be welded into an integral portion. For example, one end of the iron core 50 may be engaged with and stopped by the base, while the other end may be integrally welded to the position-determining portion of the position-regulating member.

Moreover, when a sealing material is injected into the laser welding hole of the base, and solidified therein, it is possible to ensure the sealing property. In particular, in the case when the through holes are formed in the position-determining portions, the resulting advantage is that the electromagnetic block 30 can be secured to the base 10 more firmly.

Figure 5:
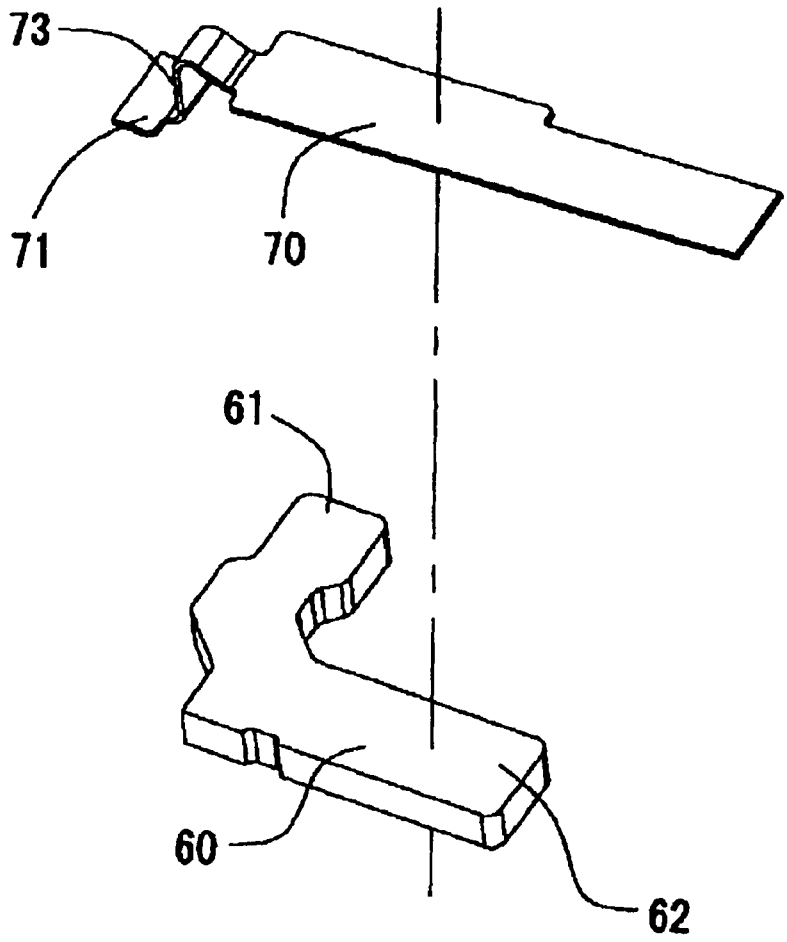
FIG. 5 is a perspective view showing the movable iron member and the movable contact member shown in FIG. 2.
Figure 6:
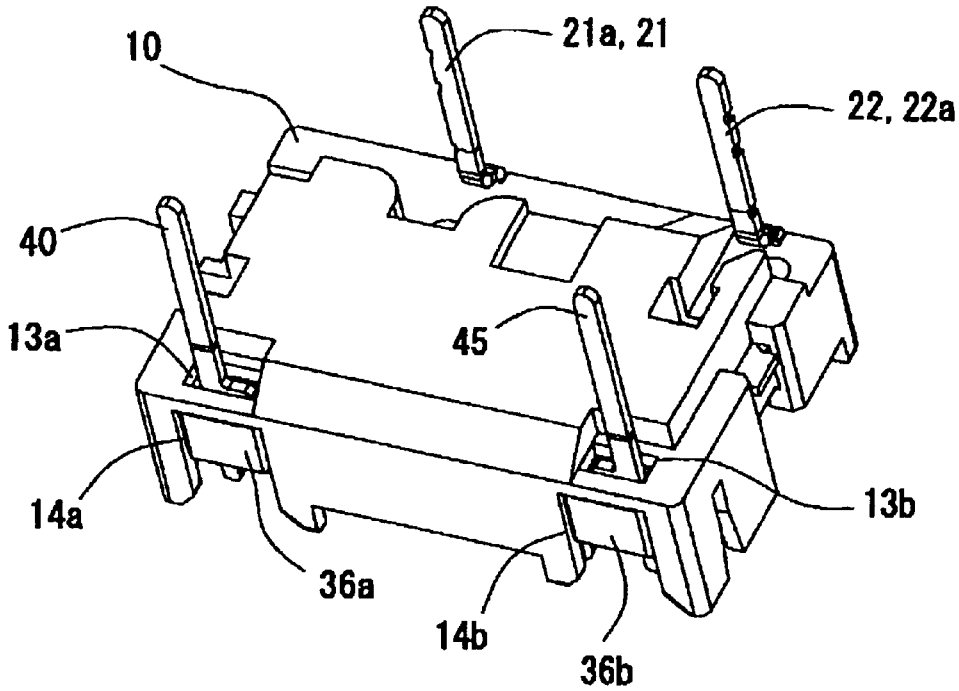
FIG. 6 is an exploded perspective view obtained when the first embodiment is viewed from a different angle.
Figure 6:
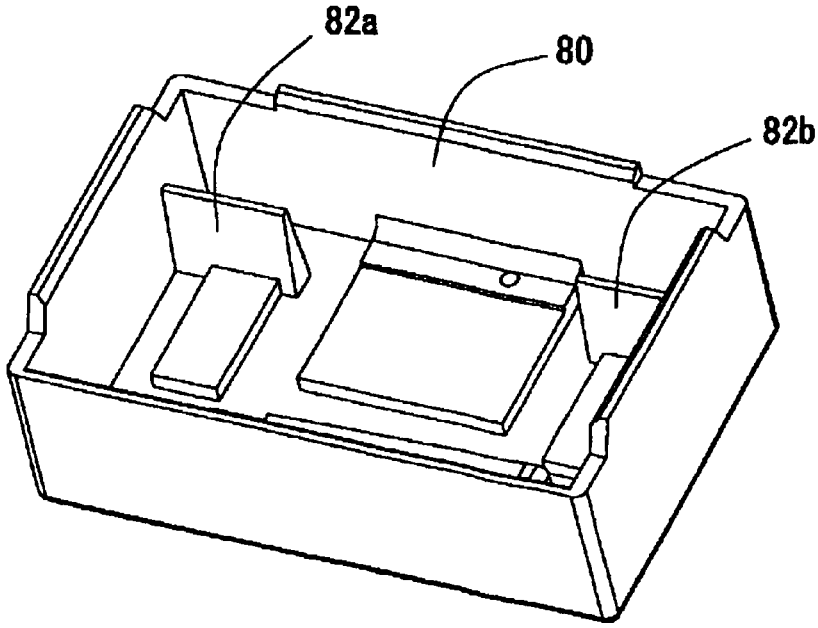

As shown in FIG. 5, the movable iron member 60 is a plate-shaped magnetic member having a virtually L-letter shape on its plan view, and a lower-face edge portion 61*a* of one end 61 thereof is allowed to serve as a rotation fulcrum (FIG. 7), with the other end 62 serving as an adsorb portion 62 that is adsorbed to the magnetic pole portion 52 of the iron core 50.

The movable contact member 70 is made of a conductive, thin plate-spring member, and its one end is bent to form a connecting end portion 71 with the movable contact 72 being attached to the lower face of the other end (FIG. 7).

The above-mentioned movable contact member 70 is welded onto the upper face of the movable iron member 60 as an integral part.

Figure 9A:
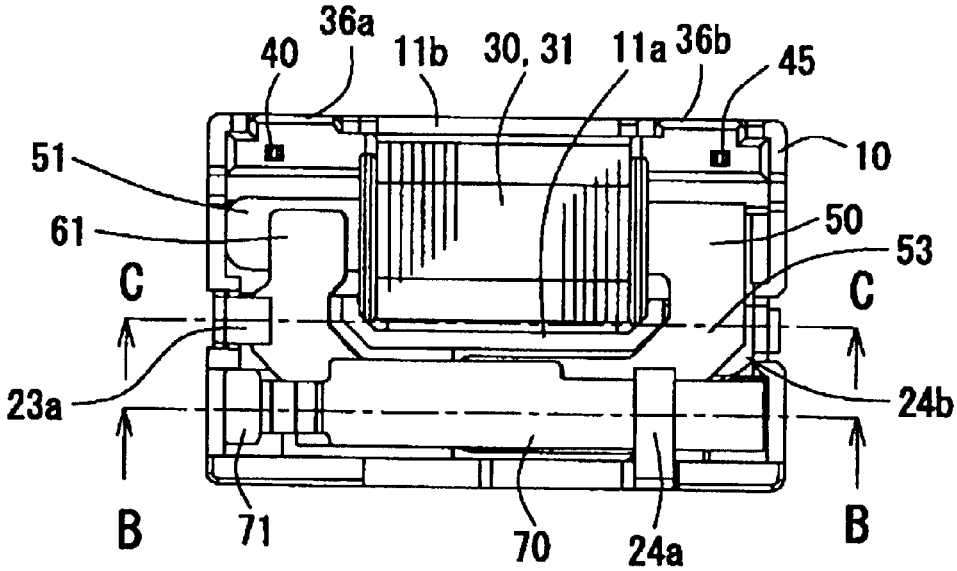
FIG. 9A is a plan view.
Figure 9B:
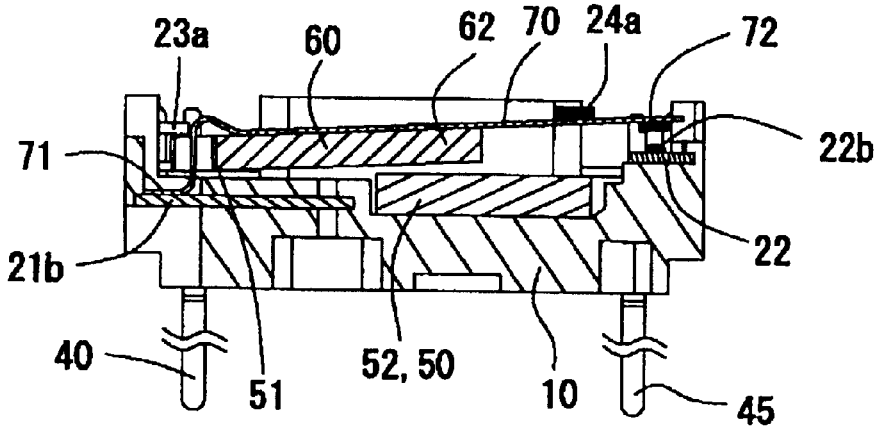
FIG. 9B is a cross-sectional view taken along line B—B of FIG. 9A.

As shown in FIG. 9B, the connecting end 71 of the movable contact member 70 is positioned at a connection-receiving section 21*b* of the movable contact terminal 21 that is exposed to the bottom face of the base 10, and integrally welded through resistance welding or laser welding so that the movable contact 72 is allowed to face the fixed contact 22*b* so as to be made in contact with and separated from it. In this case, as shown in FIG. 7, since the straight portion of the bending portion 73 of the movable contact member 70 and the lower face edge portion 61 of the movable contact member 60 are placed on the same vertical face so that it is possible to prevent positional deviations in the rotation fulcrum.

Figure 9C:
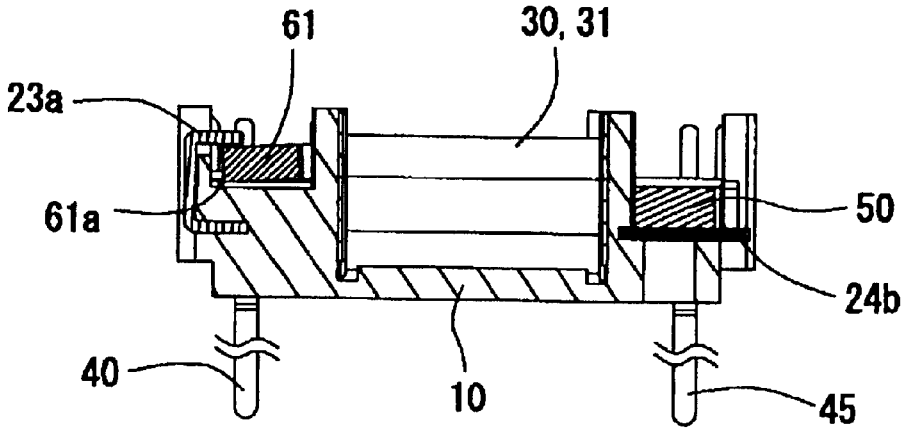
FIG. 9C is a cross-sectional view taken along line C—C of FIG. 9A.
Figure 10A:
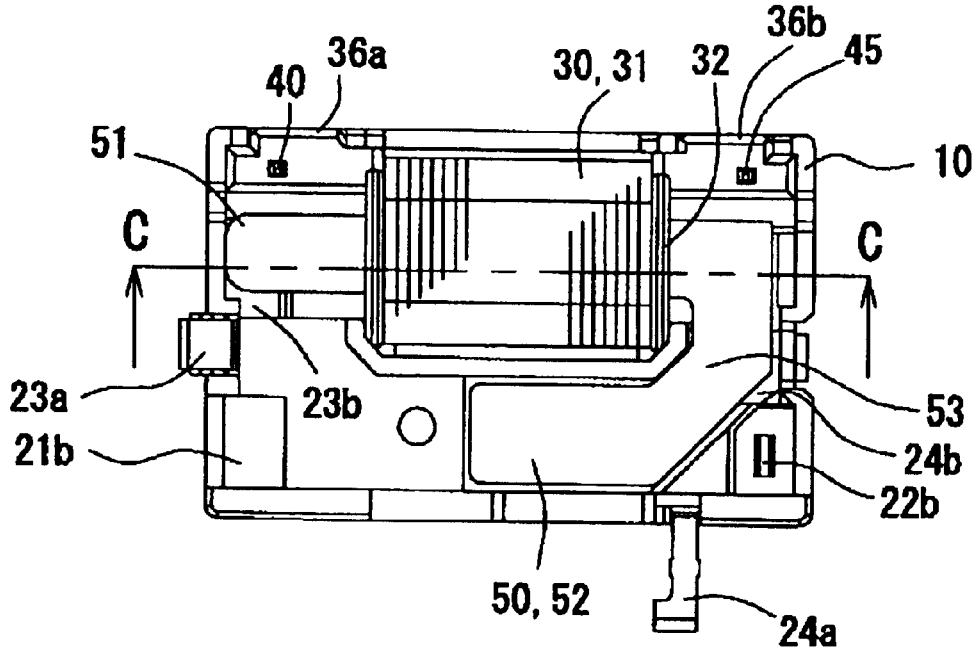
FIG. 10A is a plan view.
Figure 10B:
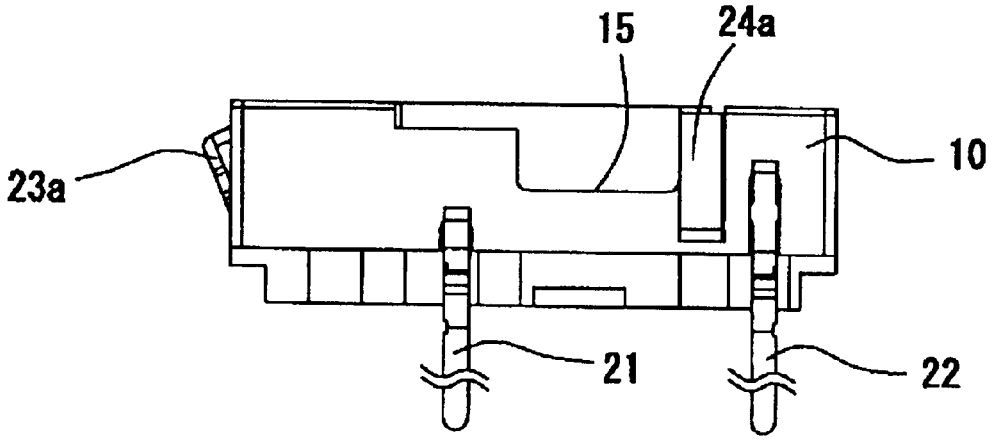
FIG. 10B is a side view of FIG. 10A.
Figure 10C:
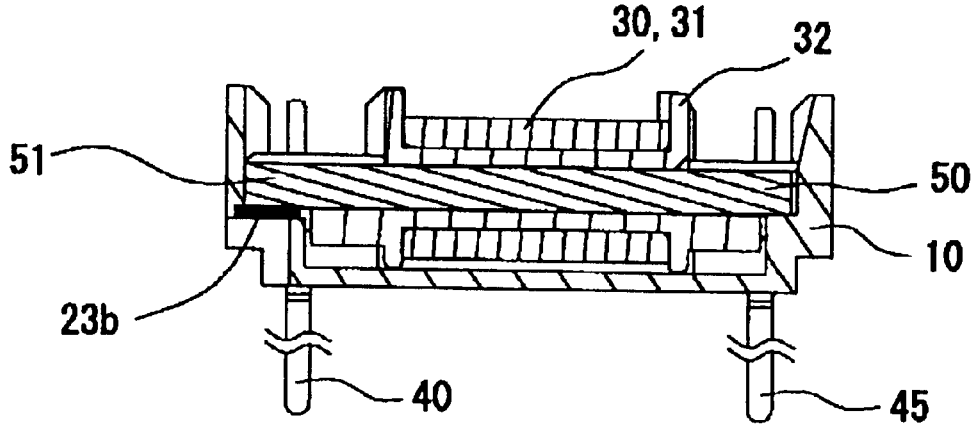
FIG. 10C is a cross-sectional view taken along line C—C of FIG. 10A.

Next, the position-regulating tongue-shaped member 23*a* of the position-regulating member 23 is bent and raised so that the vicinity of one end 61 of the movable iron member 60 is position-regulated so that the movable iron member 60 is supported so as to freely pivot on the lower face edge portion 61*a* of one end serving as a rotation fulcrum (FIG. 9C). Therefore, no abrasion powder is generated by the operation of the movable iron member 60, making it possible to prevent the occurrence of contact failure.

On the other hand, since the position-regulating tongue-shaped member 24*a* is bent and raised so that the movable contact member 70 is position-regulated in its restoring position (FIG. 9B). For this reason, it is possible to determine the operation characteristics prior to the installation of the case 80, and consequently to provide a product having stable quality.

The case 80 has an external shape that is capable of being fitted to the above-mentioned base 10, and a gas-releasing hole 81 is formed in the upper face edge portion. Then, by fitting the case 80 to the base 10, protruding sleeves 82*a*, 82*b* (FIG. 6) formed on the ceiling face of the case 80 are allowed to respectively separate the iron core 50 and the connecting portions 42, 47 of the coil terminals 40, 45. For this reason, it is possible to increase the creepage distance of insulation and consequently to improve the insulating property.

After assembling the case 80 to the base 10 in which inner constituent parts have been installed, a sealing material is injected to the rear face of the base 10. With this process, the sealing material is allowed to seal not only the gap between the base 10 and the case 80, but also the coil terminal holes 13*a*, 13*b*. For this reason, the electromagnetic block 30 is firmly secured to the base 10. In particular, in the present embodiment, an insert-molding process is carried out in the base 10, and the sealing material is also allowed to flow into parts that are visually viewed from the rear face of the base 10, and to adhere thereto to be solidified thereon. Thus, it is possible to ensure the sealing property more positively.

Next, the following description will discuss the operation of the electromagnetic relay having the above-mentioned structure.

In the case when the electromagnetic block 30 is not excited, the movable iron member 60 is pressed upward by the spring force of the movable contact member 70 so that the movable contact 72 is separated from the fixed contact 22*b*.

When a voltage is applied to the coil 31 to excite the electromagnetic block 30, the magnetic pole portion 52 of the iron core 50 is allowed to aspirate the adsorb portion 62 of the movable iron member 60. For this reason, the movable iron member 60 is allowed to pivot on the lower face edge portion 61*a* of one end 61 of the movable iron member 60 serving as a rotation fulcrum against the spring force of the movable contact member 70. In this case, the position-regulating tongue-shaped member 23*a* supports the vicinity of one end 61 of the movable iron member 60 so that the movable iron member 60 is stably operated. After the movable contact 72 of the movable contact member 70 has come into contact with the fixed contact 22*b*, the adsorb portion 62 of the movable iron member 60 is adsorbed onto the magnetic pole portion 52 of the iron core 50.

When the voltage application to the coil 31 is stopped so as to release the exciting state of the electromagnetic block 30, the movable iron member 60 is allowed to pivot by the spring force of the movable contact member 70 to return to its original position. In this case, the upper face of the movable contact member 70 is made in contact with the position-regulating tongue-shaped member 24*a* so as to be position-regulated.

Figure 11A:
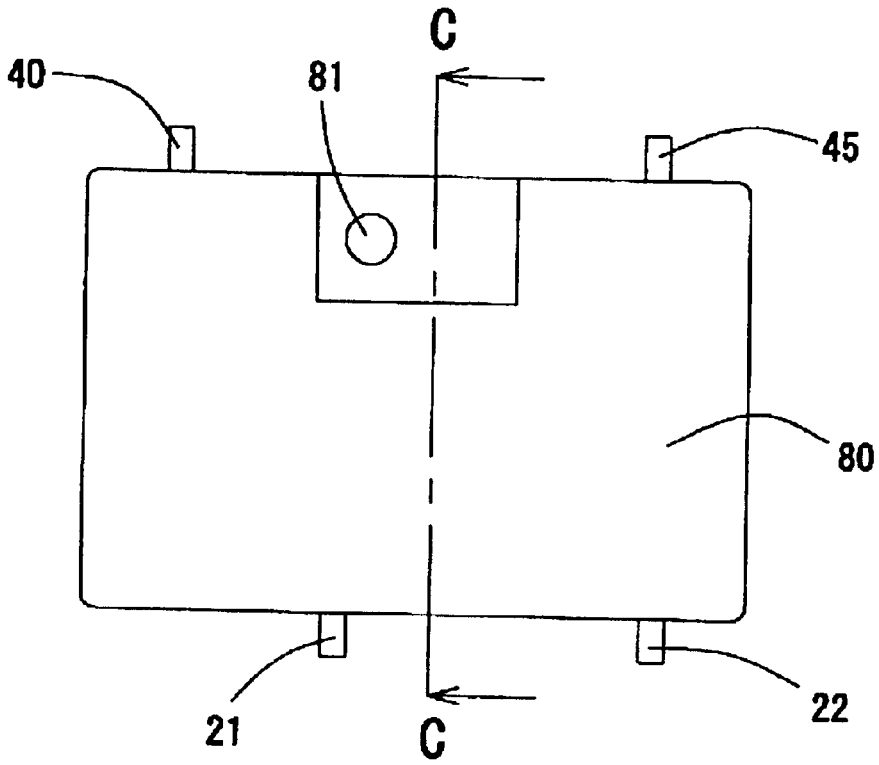
FIG. 11A is a plan view.
Figure 11B:
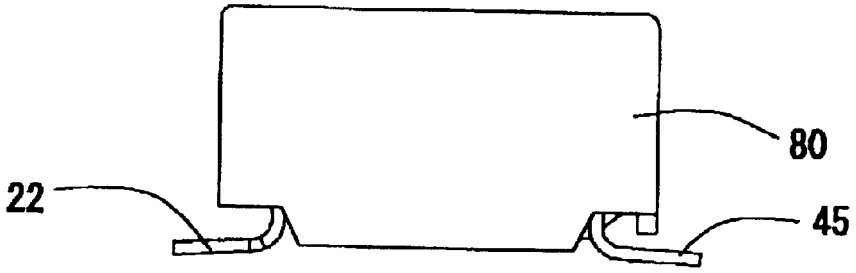
FIG. 11B is a right side view.
Figure 11C:
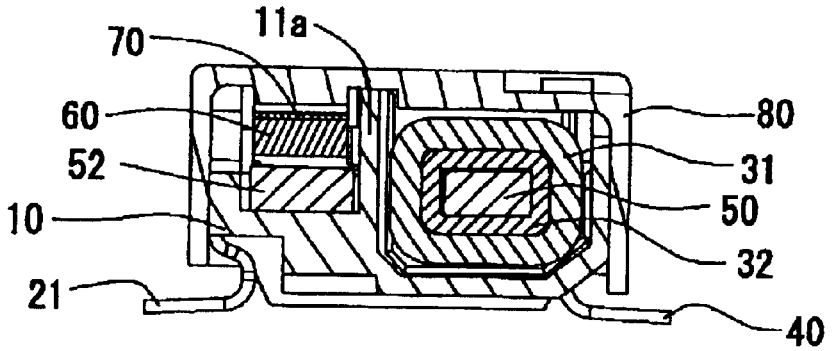
FIG. 11C is a cross-sectional view taken along line C—C of FIG. 11A.

As shown in FIG. 11, the second embodiment has an arrangement in which the respective terminals of the movable contact terminal 21, the fixed contact terminal 22 and the coil terminals 40, 45 are bent outward so that a surface-assembling electromagnetic relay is provided. The other structures are virtually the same as the above-mentioned embodiment, and the description thereof is omitted.

Figure 12:
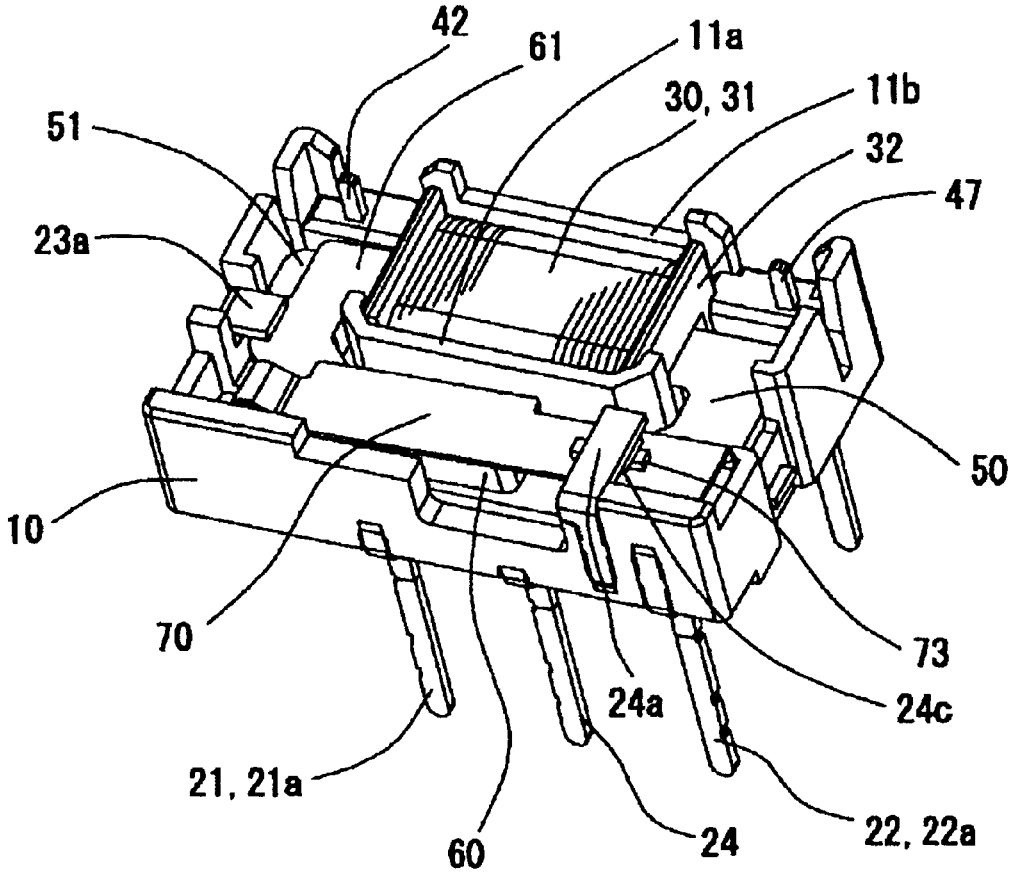
FIG. 12 is a perspective view showing an electromagnetic relay in accordance with a third embodiment of the present invention.

As shown in FIG. 12, the third embodiment has an arrangement in which the above-mentioned position-regulating member 24 is utilized as a normally-closed fixed contact terminal. In other words, common movable contacts 72 (not shown), 73 are formed on the surface and rear face of the free end of the above-mentioned movable contact member 70. Here, a fixed contact 24*c* is placed on the lower face of the one end 24*a* of the above-mentioned normally-closed fixed contact terminal 24. Therefore, when the movable contact member 70 rotates, the movable contacts 72, 73 are alternately allowed to contact the fixed contacts 22*b*, 24*c*. The other structures are virtually the same as the above-mentioned embodiment; therefore, the description thereof is omitted.

Figure 13:
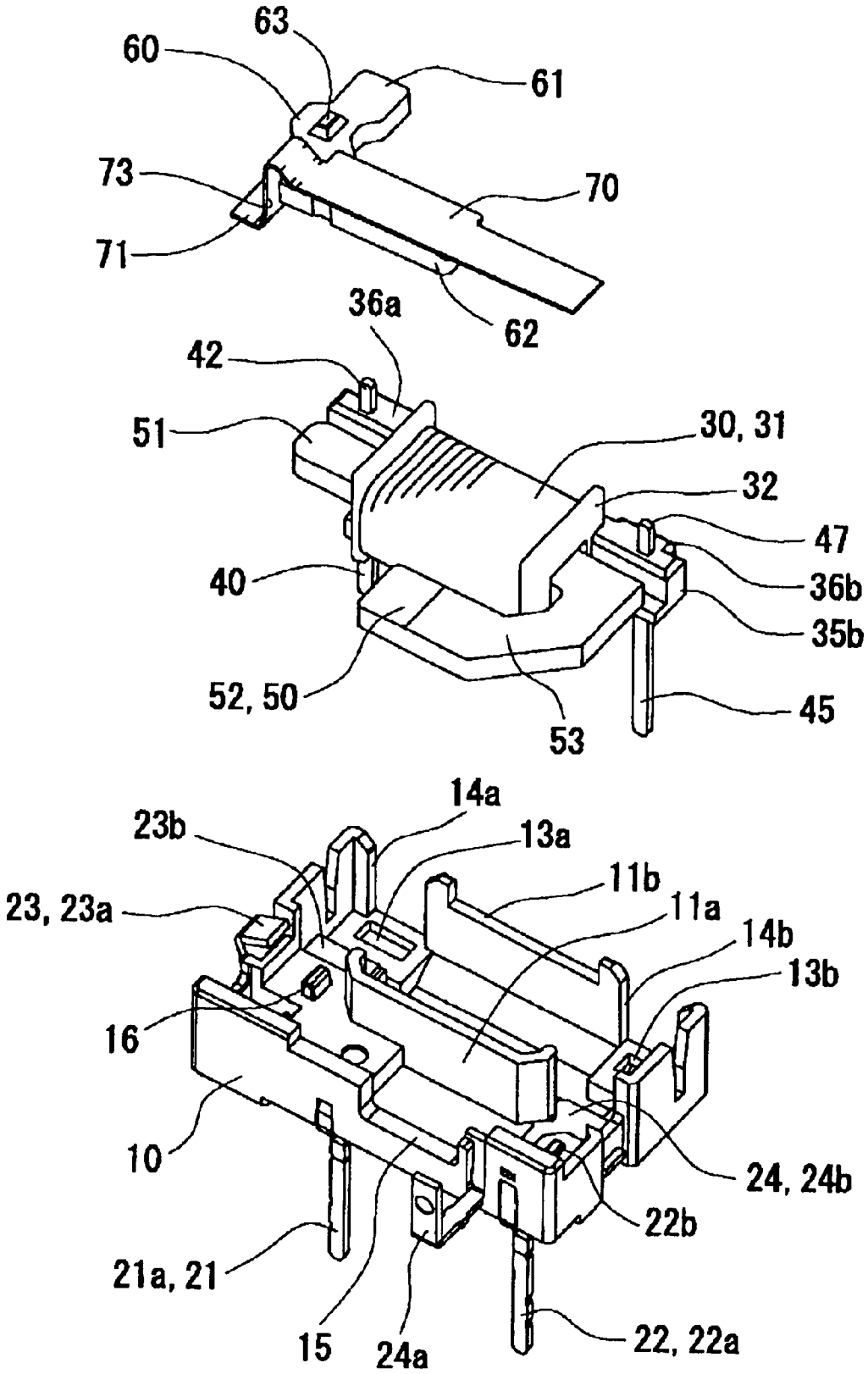
FIG. 13 is an exploded perspective view showing an electromagnetic relay in accordance with a fourth embodiment of the present invention.
Figure 14:
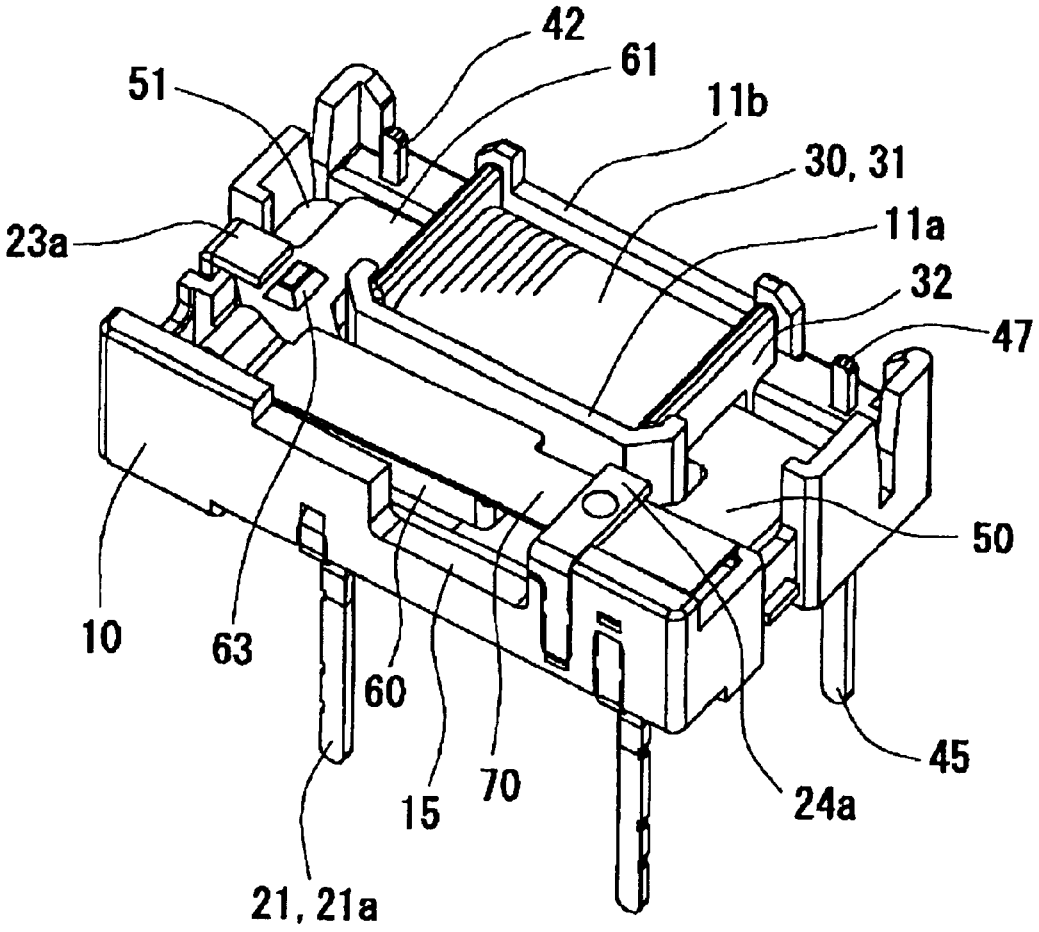
FIG. 14 is a perspective view showing the entire electromagnetic relay of FIG. 13.
Figure 15:
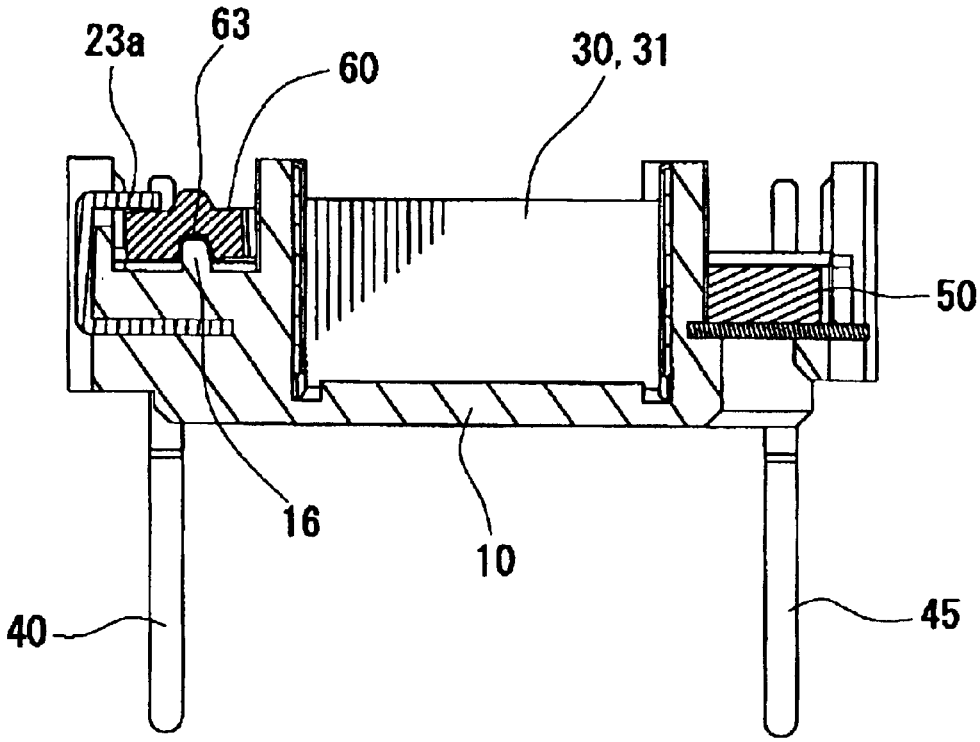
FIG. 15 is a lateral cross-sectional view of the electromagnetic relay shown in FIG. 14.

As shown in FIGS. 13 to 15, the fourth embodiment has an arrangement in which a position-regulating protrusion 16 is formed on the base 10 in a manner so as to protrude therefrom, and an insertion-receiving section 63 is formed in the vicinity of a corner of the movable iron member 60.

In the present embodiment, since the insertion-receiving section 63 of the movable iron member 60 is fitted to the protrusion 16 of the base 10 so as to freely move thereon so that when the movable iron member 60 rotates, it does not cause any interference with the smooth rotation movements. Further, even in the case when an impact force is externally applied, since the movable iron member 60 is position-regulated by the protrusion 16, it is possible to prevent the hinge spring 70 from being plastically deformed, and consequently to prevent the movable iron member 60 from coming off.

Here, the above-mentioned insertion-receiving section 63 may be a recessed section that is formed by an extrusion machining process, or a through hole that is formed through press working. The other structures are virtually the same as the above-mentioned embodiment; therefore, the description thereof is omitted.

In accordance with the present invention, one end of the movable iron member, which is supported by the support-receiving portion so as to freely pivot thereon, is designed to have a wider width and to be heavier than that of the other end of the movable iron member that faces the magnetic pole portion of the iron core so as to be attracted thereto. Therefore, even when the movable iron member is allowed to pivot through the hinge spring, the other end of the movable iron member is less susceptible to deviation; thus, it becomes possible to provide an electromagnetic relay having stable operation characteristics.

Moreover, since the iron core can be assembled onto a molded spool, it is possible to eliminate the necessity of the insert-molding process, and consequently to provide an inexpensive electromagnetic relay having low production costs.

What is claimed is:

1. An electromagnetic relay comprising:

an iron core which has a virtually J-letter shape on a plan view with one end serving as a support-receiving portion and the other end serving as a magnetic pole portion, and is provided with an exciting coil wound around in the middle portion thereof;

a movable iron member which is supported by a hinge spring attached thereto, and has a virtually L-letter shape on a plan view with one end being supported on said support-receiving portion so as to freely pivot thereon and the other end facing the magnetic pole portion of said iron core; and a contact unit which allows a fixed contact and a movable contact to contact each other and to separate from each other through rotation of said movable iron member within a plane perpendicular to the plane of the J-letter shape of the iron core.

2. The electromagnetic relay according to claim 1, wherein one end of said iron core is inserted into and attached to a through hole of a spool around which the exciting coil is wound.

3. An electromagnetic relay comprising:

an iron core which has a virtually J-letter shape on a plan view with one end serving as a support-receiving portion and the other end serving as a magnetic pole portion, and is provided with an exciting coil wound around in the middle portion thereof;

a movable iron member which is supported by a hinge spring attached thereto, and has a virtually L-letter shape on a plan view with one end being supported on said support-receiving portion so as to freely pivot thereon and the other end facing the magnetic pole portion of said iron core; and a contact unit which allows a fixed contact and a movable contact to contact each other and to separate from each other through a rotation of said movable iron member, wherein an insertion-receiving section to which a position regulation protrusion, formed on the bottom face of a base, is fitted so as to freely move therein, is formed in the vicinity of a corner of said movable iron member.

4. An electromagnetic relay comprising:

an iron core which has a virtually J-letter shape on a plan view with one end serving as a support-receiving portion and the other end serving as a magnetic pole portion, and is provided with an exciting coil wound around in the middle portion thereof;

a movable iron member which is supported by a hinge spring attached thereto, and has a virtually L-letter shape on a plan view with one end being supported on said support-receiving portion so as to freely pivot thereon and the other end facing the magnetic pole portion of said iron core, the hinge spring being a movable contact member; and a contact unit which allows a fixed contact and a movable contact to contact each other and to separate from each other through a rotation of said movable iron member, wherein an insertion-receiving section to which a position regulation protrusion, formed on the bottom face of a base, is fitted so as to freely move therein, is formed in the vicinity of a corner of said movable iron member.

* * * * *